US009922789B2

(12) United States Patent
Fukunaga

(10) Patent No.: US 9,922,789 B2
(45) Date of Patent: Mar. 20, 2018

(54) FUSE AND METHOD FOR PRODUCING FUSE

(71) Applicant: Yazaki Corporation, Minato-ku, Tokyo (JP)

(72) Inventor: Miyuki Fukunaga, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 308 days.

(21) Appl. No.: 14/766,193

(22) PCT Filed: Feb. 5, 2014

(86) PCT No.: PCT/JP2014/052704
§ 371 (c)(1),
(2) Date: Aug. 6, 2015

(87) PCT Pub. No.: WO2014/123168
PCT Pub. Date: Aug. 14, 2014

(65) Prior Publication Data

US 2016/0005563 A1 Jan. 7, 2016

(30) Foreign Application Priority Data

Feb. 6, 2013 (JP) ..... 2013-021544

(51) Int. Cl.
*H01H 85/08* (2006.01)
*H01H 85/143* (2006.01)
(Continued)

(52) U.S. Cl.
CPC ..... *H01H 85/08* (2013.01); *H01H 69/02* (2013.01); *H01H 85/143* (2013.01);
(Continued)

(58) Field of Classification Search
CPC ..... H01H 69/02; H01H 69/022; H01H 85/08; H01H 85/11; H01H 85/143; H01H 85/15;
(Continued)

(56) References Cited

U.S. PATENT DOCUMENTS 6,452,474 B1 * 9/2002 Oh ..... H01H 85/0417 337/186
2001/0043137 A1 11/2001 Endo et al.
(Continued)

FOREIGN PATENT DOCUMENTS

JP 2001-325874 A 11/2001
JP 2004-127570 A 4/2004
(Continued)

OTHER PUBLICATIONS

Apr. 8, 2015—International Search Report—Intl App PCT/JP2014/052704.
Apr. 8, 2014—(WO) Written Opinion—App PCT/JP2014/052704.

*Primary Examiner* — Anatoly Vortman
*Assistant Examiner* — Jacob Crum
(74) *Attorney, Agent, or Firm* — Banner & Witcoff, Ltd.

(57) ABSTRACT

A fuse (1) includes a fuse element (10) having a fusible portion (13) provided between opposed inner edges (11*a*, 12*a*) of flat plate portions (11, 12), and an insulating housing (50) covering the inner edge sides of the flat plate portions and the fusible portion in a state in which outer edge (11*c*, 12*c*) sides of the flat plate portions are protruded outward from slits at respective end walls (55, 58) of the insulating housing (50). The outer edge sides of the flat plate portions are formed as terminal portions (21, 22) each having a thickness twice as large as the thickness of the flat plate portion, and protrusions (11*b*, 12*b*) provided on upper and
(Continued)

lower edges of the flat plate portions abut against inner surfaces of the end walls (55, 58) of the insulating housing (50).

5 Claims, 9 Drawing Sheets

(51) Int. Cl.

| | |
|---|---|
| ***H01H 69/02*** | (2006.01) |
| ***H01H 85/153*** | (2006.01) |
| ***H01H 85/20*** | (2006.01) |
| *H01H 85/11* | (2006.01) |
| *H01H 85/175* | (2006.01) |

(52) U.S. Cl.
CPC ..... *H01H 85/153* (2013.01); *H01H 85/2045* (2013.01); *H01H 85/11* (2013.01); *H01H 85/175* (2013.01)

(58) Field of Classification Search
CPC .. H01H 85/153; H01H 85/165; H01H 85/175; H01H 85/2045
USPC ..... 337/167, 295, 416
See application file for complete search history.

(56) References Cited

U.S. PATENT DOCUMENTS

| | | | | |
|---|---|---|---|---|
| 2002/0041224 | A1 | 4/2002 | Endo et al. | |
| 2003/0076213 | A1 | 4/2003 | Endo et al. | |
| 2006/0055497 | A1* | 3/2006 | Harris | H01H 85/045 337/14 |
| 2006/0205249 | A1* | 9/2006 | Higuchi | H01H 85/044 439/76.2 |
| 2012/0133478 | A1* | 5/2012 | Chiu | H01H 85/165 337/228 |
| 2013/0009744 | A1 | 1/2013 | Douglass | |
| 2014/0035717 | A1 | 2/2014 | Nomura et al. | |

FOREIGN PATENT DOCUMENTS

| | | | |
|---|---|---|---|
| JP | 2012-227091 | A | 11/2012 |
| JP | 2013-016487 | A | 1/2013 |

* cited by examiner

FUSE AND METHOD FOR PRODUCING FUSE

TECHNICAL FIELD

The present invention relates to a fuse configured such that a fuse element is attached to an insulating housing, the fuse element having a fusible portion provided between a pair of flat plate portions, and a method for producing the fuse.

BACKGROUND ART

FIG. 13 is an exploded perspective view of a conventional fuse described in Patent Document 1. The fuse includes a fuse element 110 having a fusible portion 113 provided between inner edges of a pair of flat plate terminal portions 111, 112 and insulating housings 151, 152 covering the inner edges of the flat plate terminal portions 111, 112 and the fusible portion 113. Outer edges of the flat plate terminal portions 111, 112 positioned on respective sides of the fusible portion 113 are exposed outside the insulating housings 151, 152. The outer edges of the flat plate terminal portions 111, 112 are held and fixed by counterpart terminals, whereby the fuse is electrically connected to the counterpart terminals.

PRIOR ART DOCUMENT

Patent Document

Patent Document 1: JP2001-325874A

SUMMARY OF INVENTION

Technical Problem

When downsizing this kind of fuse by making all components smaller and thinner, there is a problem that the temperature of the fuse element during electrical conduction may be high so that there is an increased thermal effect on the insulating housings and peripheral components. There is also a problem that, due to the reduced thickness of the flat plate terminal portions that is to be held and fixed by the counterpart terminals, the holding and fixing force may become weak.

The present invention has been made in view of the above circumstances, and it is an object of the present invention to provide a fuse and a method for producing the fuse, which can solve the thermal problem of the fuse element during electrical conduction and the problem of the weak holding and fixing force when the flat plate terminal portions are held and fixed by the counterpart terminals, in a case in which the product is downsized.

Solution to Problem

The above object of the present invention is achieved by the following configuration.

(1) A fuse including:

a fuse element having a pair of flat plate portions forming terminal portions at both ends of the fuse element and a fusible portion provided between opposed inner edges of the pair of flat plate portions, the flat plate portions being formed to have a uniform thickness; and an insulating housing formed in a box shape and provided to cover inner edge sides of the pair of flat plate portions and the fusible portion in a state in which outer edge sides of the pair of flat plate portions are protruded outward from slits formed at opposed end walls of the insulating housing, wherein the pair of flat plate portions protruded outward from the slits at the end walls of the insulating housing are folded into a plurality of layers to form the outer edge sides of the flat plates as the terminal portions each having a greater thickness than each of the flat plate portions, and wherein protrusions provided on side edges of portions of the pair of flat plate portions placed inside the insulating housing abut against inner surfaces of the end walls of the insulating housing.

(2) The fuse according to (1), wherein a fuse element insertion port from which the fuse element is inserted is provided at one end of the insulating housing, and one of the end walls is provided as a lid that closes the fuse element insertion port after inserting the fuse element, and in a state in which the fuse element insertion port is closed after inserting the fuse element, the lid is locked from an outside by one of the terminal portions formed by folding the flat plate portions.

(3) A method for producing a fuse, the method including steps of:

preparing a fuse element having a pair of first and second flat plate portions forming terminal portions at both ends of the fuse element and a fusible portion provided between opposed inner edges of the first and second flat plate portions, at least the flat plate portions being formed by punching a flat metal plate having a uniform thickness;

preparing an insulating housing having a rectangular cylindrical body and a pair of end walls configured to close openings at end portions of the rectangular cylindrical body, one of the pair of end walls being provided as a fixed wall having a slit through which the first flat plate portion is inserted and fixedly closing one of the openings at the end portions of the rectangular cylindrical body, the other of the pair of end walls being rotatably connected to the rectangular cylindrical body via a hinge and provided as a lid that closes the other of the openings at the end portions of the rectangular cylindrical body after inserting the fuse element, the other of the openings being opened as a fuse element insertion port, and the lid having a slit through which the second flat plate portion is inserted on a side edge opposite to the hinge;

inserting the first flat plate portion of the fuse element into the insulating housing from the fuse element insertion port such that an outer edge side of the first flat plate portion protrudes outward from the insulating housing through the slit of the fixed wall and such that a protrusion provided on a side edge of the first flat plate portion abuts against an inner surface of the fixed wall to position the fuse element relative to the insulating housing, so that inner edge sides of the first and second flat plate portions and the fusible portion of the fuse element are accommodated inside the insulating housing;

rotating the lid after the inserting step to close the fuse element insertion port such that an outer edge side of the second flat plate portion is protruded outward from the insulating housing through the slit of the lid an such that the lid abuts against a protrusion provided on a side edge of the second flat plate portion to position the lid at a closed position;

folding the second flat plate portion protruded outward from the insulating housing into a plurality of layers after the lid has been closed, such that the outer edge side of the second flat plate portion is formed as a second terminal portion having a greater thickness than the flat metal plate and such that the lid is locked from an outside by the second terminal portion; and folding the first flat plate portion into a plurality of layers after or before the fuse element is inserted into the insulating housing, such that the outer edge side of the flat plate portion is formed as a first terminal portion having a greater thickness than the flat metal plate.

According to the fuse having the configuration (1) described above, the thickness of each terminal portion exposed outside the insulating housing increases to be several times as large as the thickness of the raw material (the flat metal plate) of the fuse element. Therefore, it is possible to increase a thermal distribution region during electrical conduction and it is possible to suppress the temperature of the fuse element from increasing. Accordingly, it is possible to solve the problem of the thermal effect on the insulating housing or its periphery when the fuse is downsized. In addition, when the terminal portions are held and fixed by counterpart terminals, the force with which the counterpart terminals hold and fix the fuse can be enhanced because the thickness of each of the terminal portions has increased. Accordingly, it is possible to prevent the fuse from being mounted unstably when the fuse is downsized. In addition, when the protrusions formed in the fuse element abut against the inner surfaces of the end walls of the insulating housing, the fuse element is positioned. Accordingly, it is possible to determine the positional relation between the insulating housing and the fuse element accurately and it is possible to make the quality of the fuse stable.

According to the fuse having the configuration (2) described above, the fuse element is inserted from the fuse element insertion port provided in the one end portion of the insulating house, and the fuse element insertion port is closed by the lid after the insertion of the fuse element. In this state, the lid is locked from the outside by the terminal portion which is formed by folding the flat plate portion of the fuse element. Consequently, the lid can be fixed so as not to be opened.

According to the method for producing the fuse having the configuration (3) described above, the fuse element is inserted from the fuse element insertion port of the insulating housing, and the fuse element insertion port is closed by the lid after the insertion of the fuse element. In addition thereto, the lid is locked from the outside by the terminal portion which is formed by folding the flat plate portion of the fuse element. Accordingly, it is possible to easily assemble the fuse having a robust structure. In addition, the thickness of each of the terminal portions exposed outside the insulating housing increases to be several times as large as the thickness of the raw material (flat metal plate) of the fuse element. Therefore, it is possible to increase a thermal distribution region during electrical conduction and it is possible to suppress the temperature of the fuse element from increasing. Accordingly, it is possible to solve the problem of the thermal effect on the insulating housing or its periphery when the fuse is downsized. In addition, when the terminal portions are held and fixed by counterpart terminals, the force with which the counterpart terminals hold and fix the fuse can be enhanced because the thickness of each of the terminal portions has increased. Accordingly, it is possible to prevent the fuse from being mounted unstably when the fuse is downsized. In addition, when the protrusions formed in the fuse element abut against the inner surfaces of the end walls (the fixed wall and the lid) of the insulating housing, the fuse element is positioned. Consequently, it is possible to determine the positional relation between the insulating housing and the fuse element accurately and it is possible to make the quality of the fuse stable.

While the present invention has been briefly described above, details of the present invention will be further apparent by reading through a mode for carrying out the invention (hereinafter "embodiment") described below with reference to the accompanying drawings.

DESCRIPTION OF EMBODIMENT

Figure 1A:
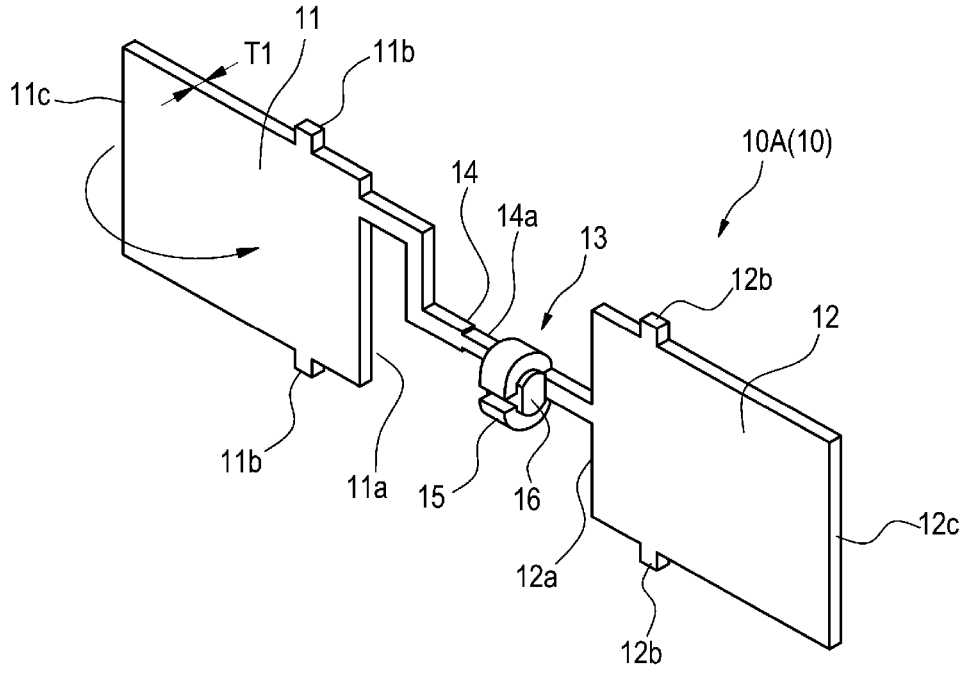
FIGS. 1A and 1B illustrate a configuration of an intermediate product of a fuse element for producing a fuse according to an embodiment of the invention, FIG. 1A illustrating a state in which an outer edge side of a first flat plate portion has not been folded, and FIG. 1B illustrating a state in which the outer edge side of the first flat plate portion has been folded to form a double layer terminal portion.
Figure 1B:
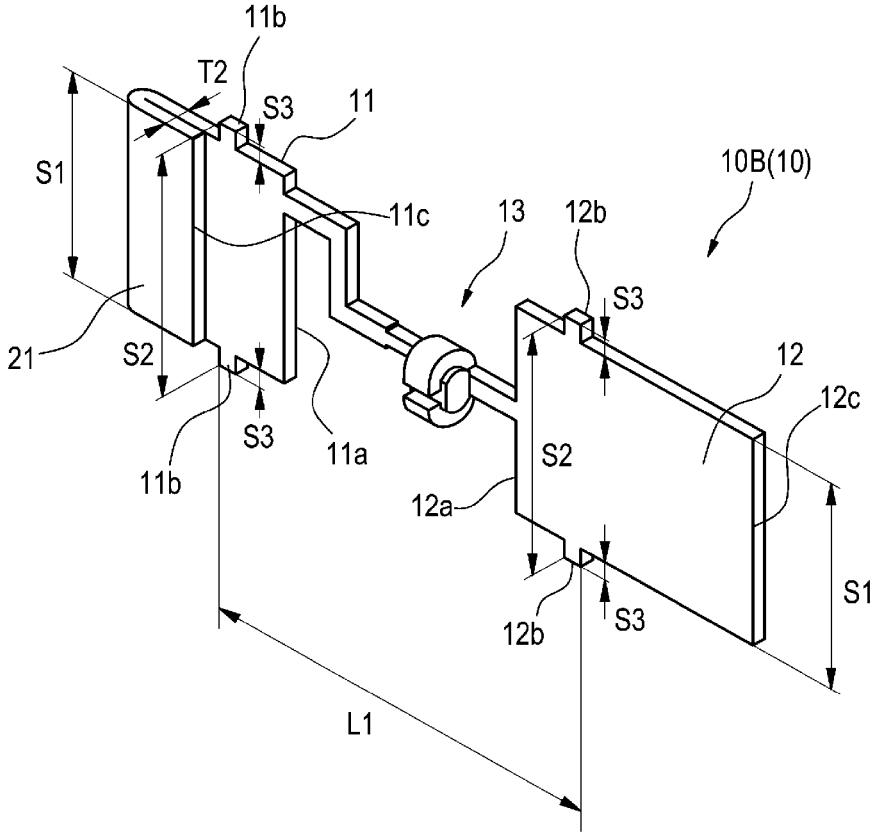
Figure 2A:
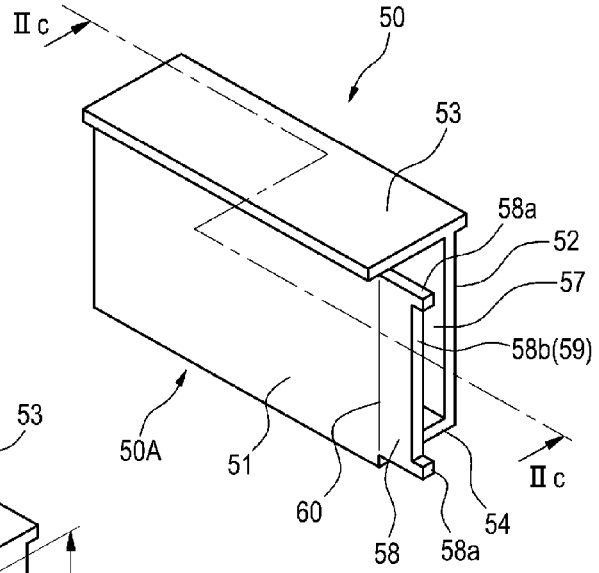
FIGS. 2A to 2C illustrate a configuration of an insulating housing for producing the fuse according to the embodiment of the invention, FIG. 2A being a perspective view seen from a fuse element insertion port side, FIG. 2B being a perspective view seen from the opposite side of FIG. 2A, and FIG. 2C being a sectional view taken along the line IIc-IIc of FIG. 2A.
Figure 2B:
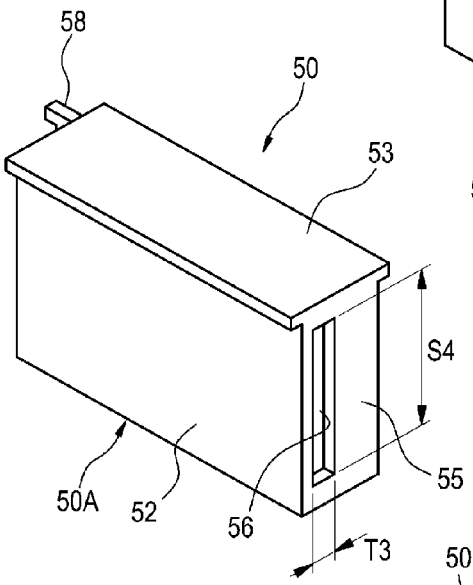
Figure 2C:
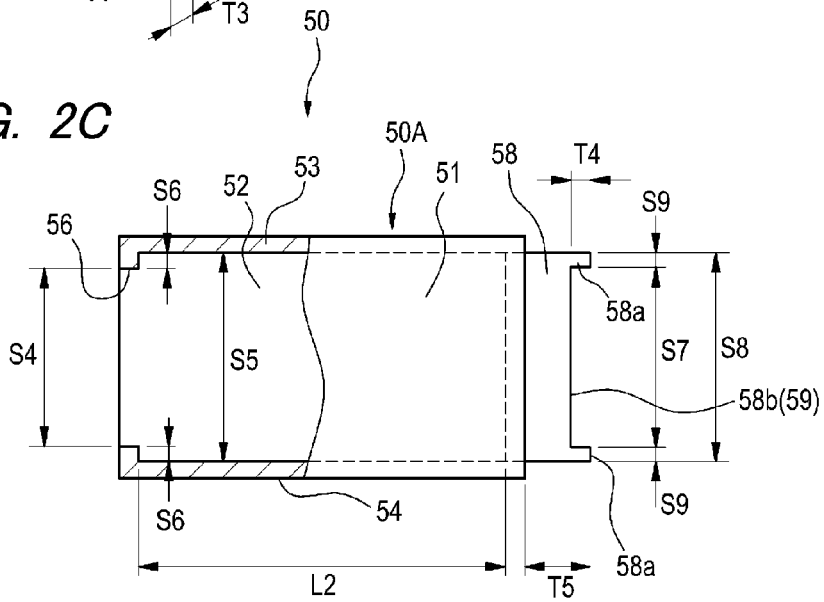
Figure 3:
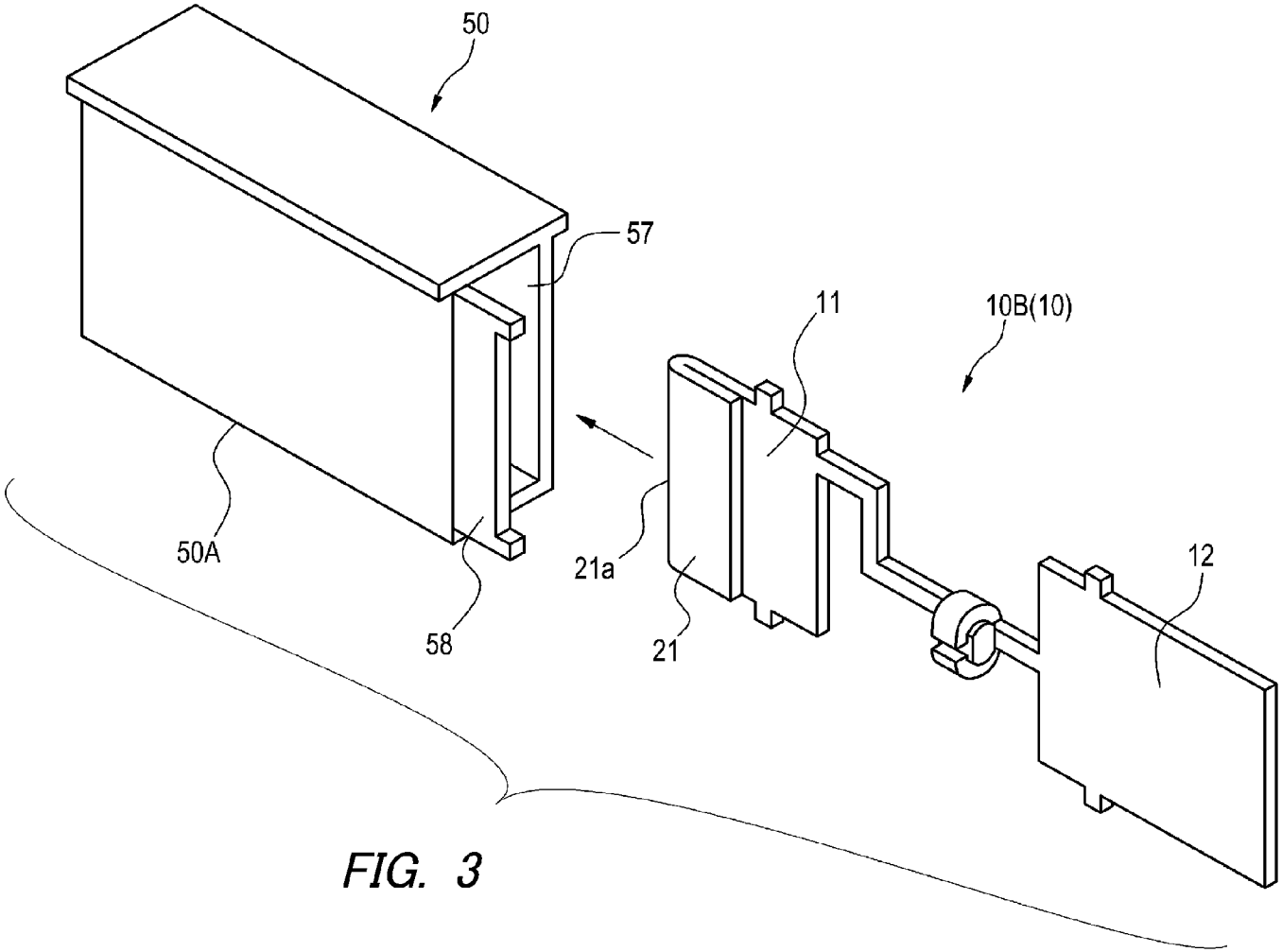
FIG. 3 is a perspective view illustrating a state in which the fuse element is to be inserted into the insulating housing, explaining a process for producing the fuse according to the embodiment of the invention.
Figure 4:
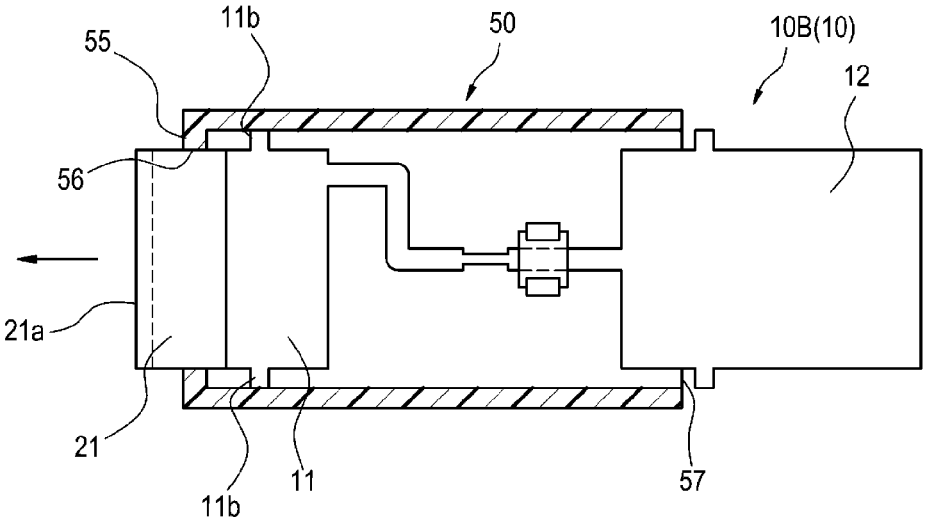
FIG. 4 is a sectional view illustrating a state in which the fuse element is being inserted into the insulating housing according to the embodiment of the invention.
Figure 5:
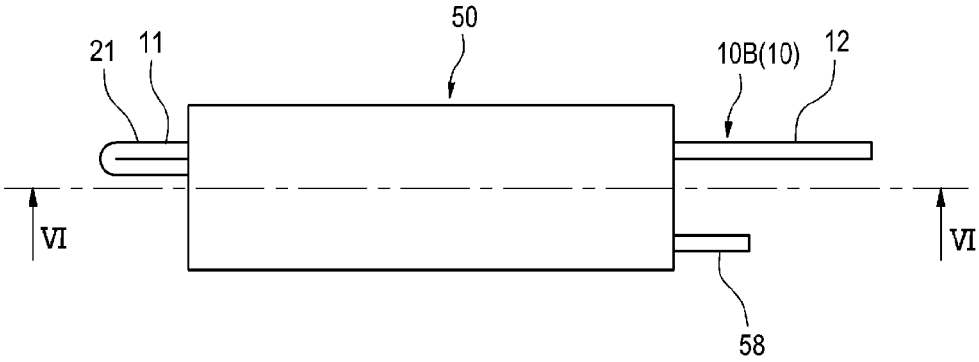
FIG. 5 is a top view illustrating a state in which the fuse element has been inserted into the insulating housing according to the embodiment of the invention.
Figure 6:
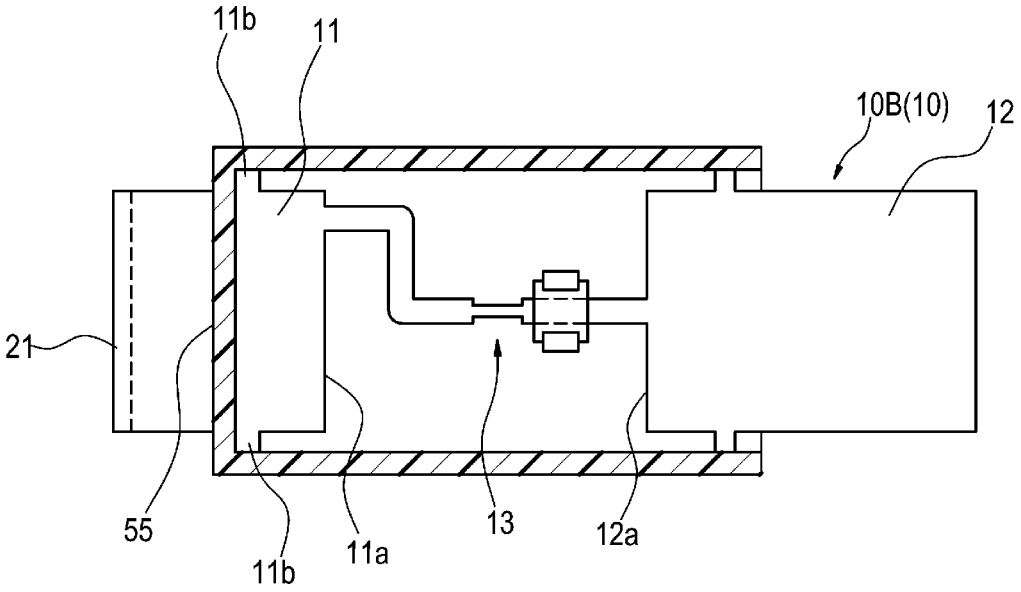
FIG. 6 is a sectional view taken along the line VI-VI of FIG. 5.
Figure 8:
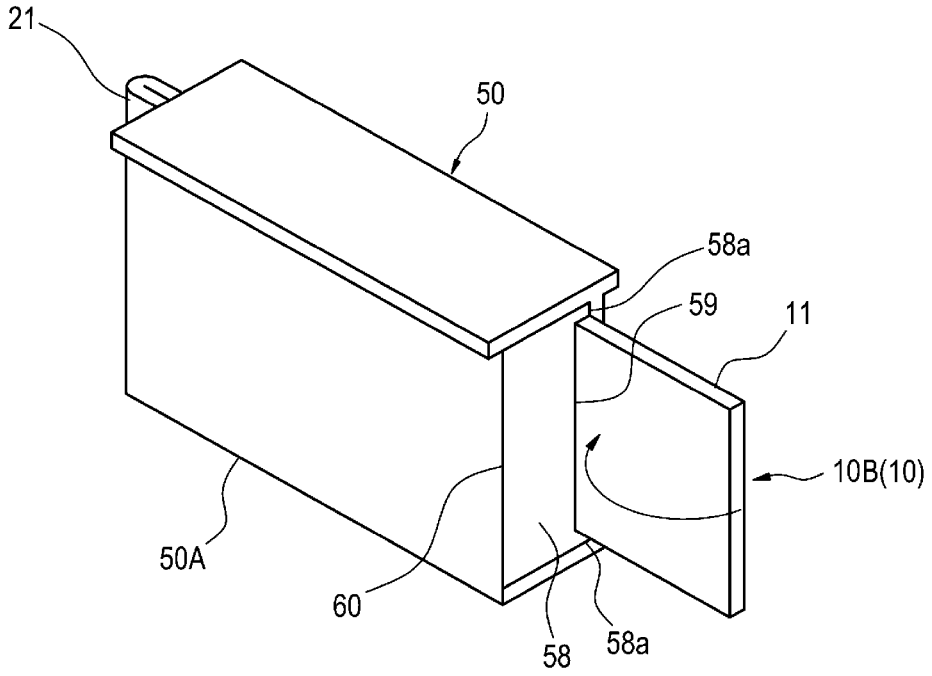
FIG. 8 is a perspective view illustrating a state in which a lid has been closed from the state of FIG. 7.
Figure 9:
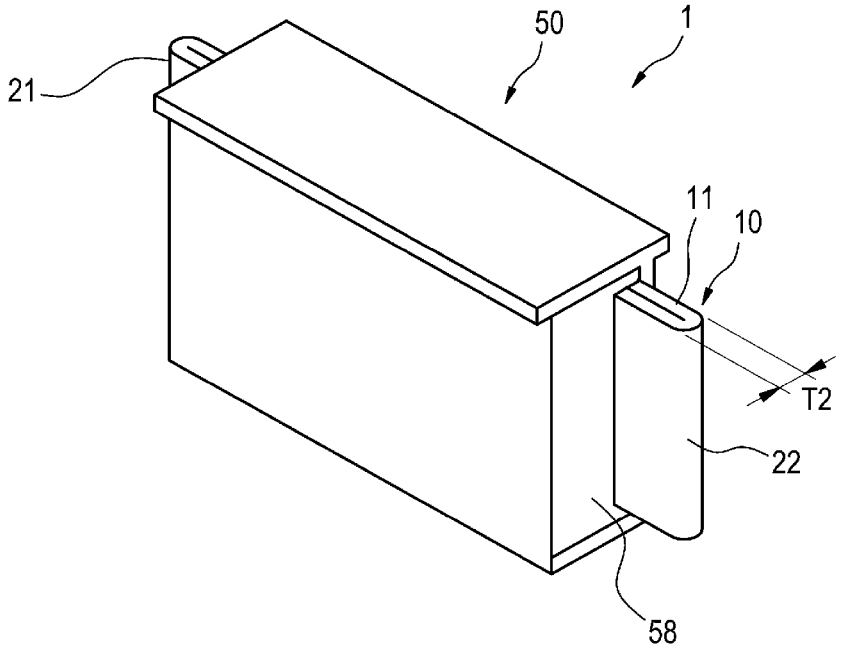
FIG. 9 is a perspective view illustrating a state in which an outer edge portion of a second flat plate portion has been folded from the state of FIG. 8 to complete the fuse according to the embodiment.
Figure 10:
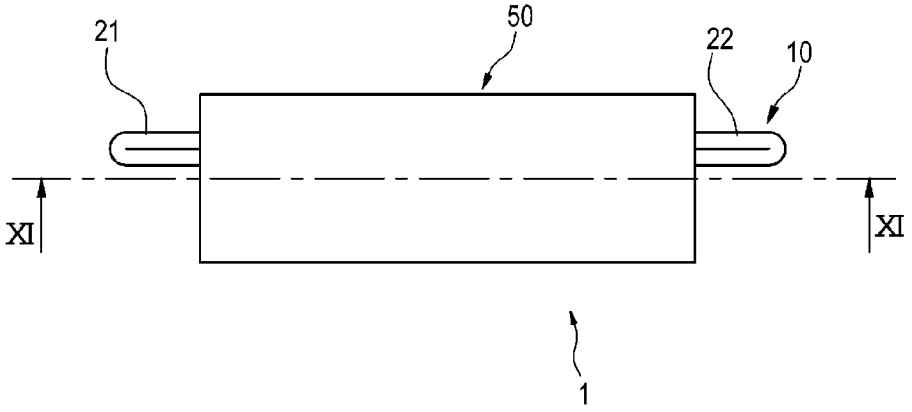
FIG. 10 is a top view of the completed fuse.
Figure 11:
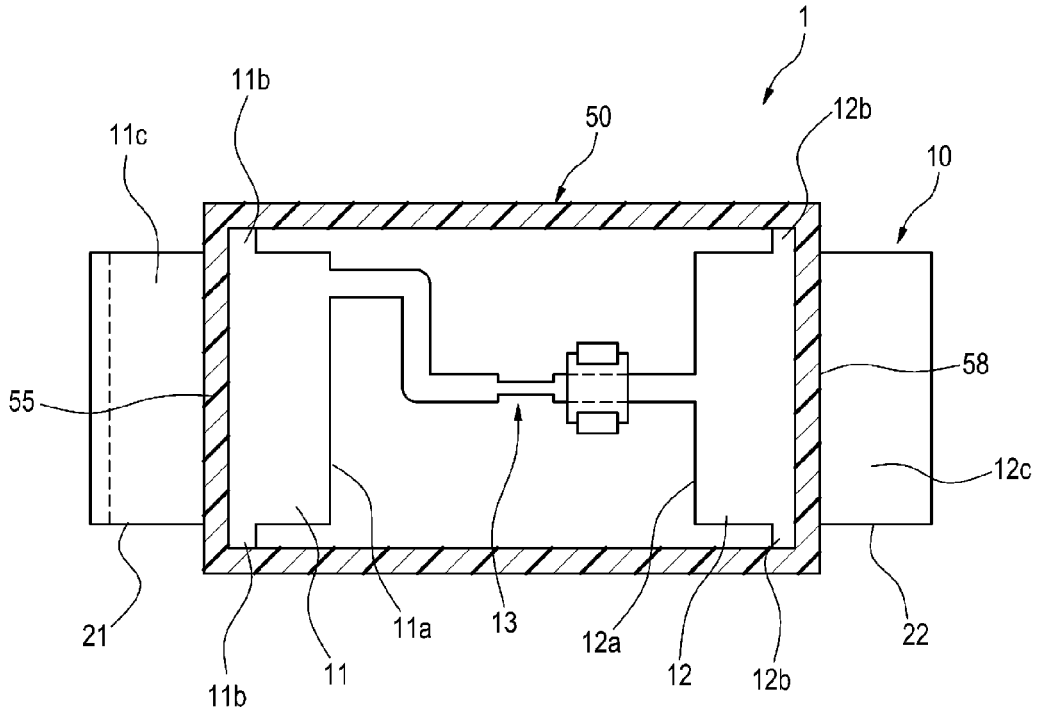
FIG. 11 is a sectional view taken along the line XI-XI of FIG. 10.
Figure 12:
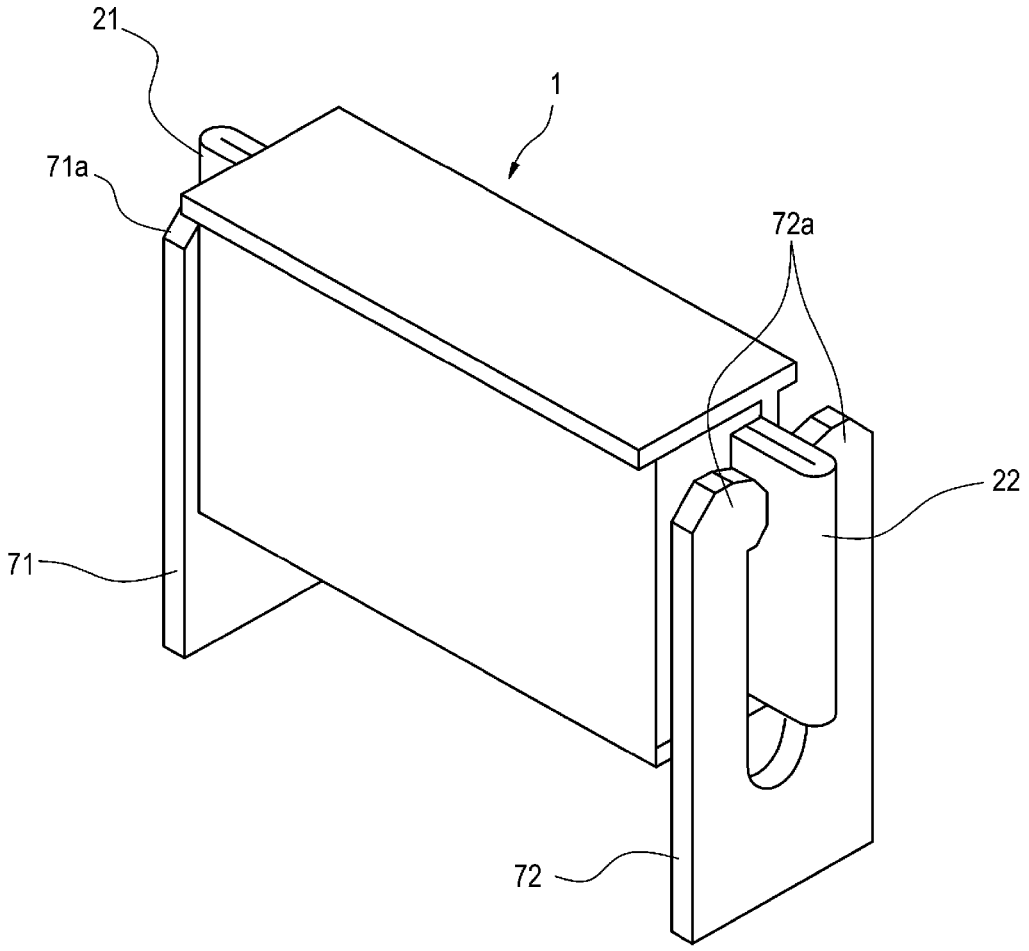
FIG. 12 is a perspective view illustrating a state in which two terminal portions of the completed fuse are held between holding arms of counterpart terminals in a fixed manner.
Figure 13:
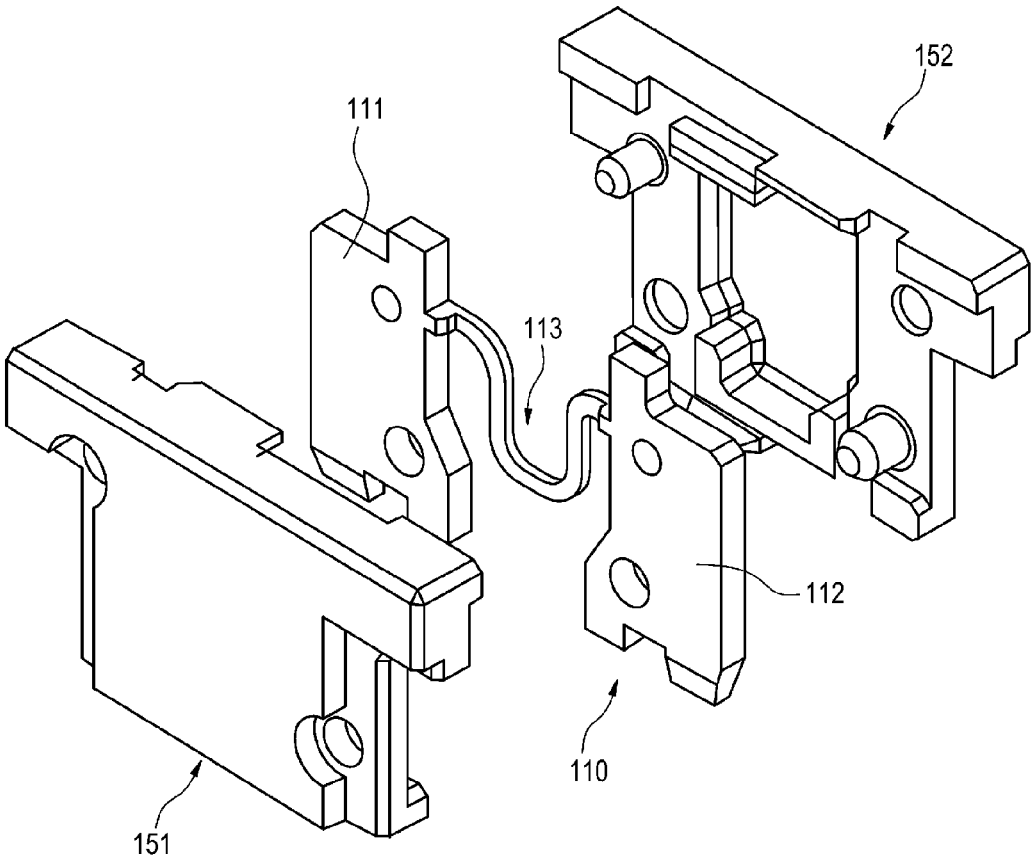
FIG. 13 PRIOR ART
FIG. 13 is an exploded perspective view of a conventional fuse.

A fuse and a method for producing the fuse according to an embodiment of the invention will be described below with reference to the drawings. FIGS. 1A and 1B are views showing the configuration of an intermediate product of a fuse element for producing the fuse according to the embodiment. FIGS. 2A to 2C are views showing the configuration of an insulating housing according to the embodiment. FIGS. 3 to 8 are views for explaining steps for producing the fuse according to the embodiment. FIGS. 9 to 11 are views showing the configuration of the completed fuse according to the embodiment. FIG. 12 is a view illustrating a state in which the completed fuse according to the embodiment is held and fixed by counterpart terminals.

A fuse element 10B (10) shown in FIG. 1B and an insulating housing 50 shown in FIGS. 2A to 2C are prepared for producing a fuse 1 according to the embodiment shown in FIGS. 9 to 12.

As shown in FIG. 1A, the fuse element 10 has a pair of first and second flat plate portions 11, 12 and a fusible portion 13. The first and second flat plate portions 11, 12 both having the same rectangular shape are provided to form terminal portions at both ends of the fuse element. The fusible portion 13 is provided between opposed inner edges 11*a*, 12*a* of the first and second flat plate portions 11, 12. All the inner edges 11*a*, 12*a* and outer edges 11*c* and 12*c* of the first flat plate portion 11 and the second flat plate portion 12 are parallel with one another. Upper edges and lower edges of the first flat plate portion 11 and the second flat plate portion 12 are located on the same straight lines respectively.

The fusible portion 13 is a portion in which the sectional area where a current can flow is so small that the fusible portion 13 can be fused easily by Joule heat when an overcurrent flows therein. The fusible portion 13 includes a belt plate-like coupling portion 14 and a low melting point metal chip 16. The belt plate-like coupling portion 14 is press-molded integrally with the flat plate portions 11, 12. The low melting point metal chip 16 is held by a caulking piece 15 in the vicinity of a fusing portion 14*a* (portion having a sectional area which has been locally reduced) of the belt plate-like coupling portion 14.

The belt plate-like coupling portion 14 of the fusible portion 13, and the opposite flat plate portions 11, 12 connected by the belt plate-like coupling portion 14 are formed by punching a sheet of flat metal plate (raw material) having a uniform thickness t. Accordingly, as shown in FIG. 1A, the thickness T1 of each of the punched flat plate portions 11, 12 of the fuse element 10A satisfies the relation T1=t.

The outer edge 11*c* side of the first flat plate portion 11 is folded back to the inner side before the fuse element 10A is inserted into the insulating housing 50. Thus, the fuse element 10A is shaped into the fuse element 10B shown in FIG. 1B. That is, the outer edge 11*c* side of the first flat plate portion 11 is folded back to the inner side to provide double layer structure, so that this double layer portion is configured as a first terminal portion 21 having a thickness T2 twice as large as the original thickness T1 of the flat plate portion 11.

In addition, when the punching is performed by a press, protrusions 11*b* and 12*b* are provided in the upper edges and the lower edges of the respective flat plate portions 11, 12 of the fuse element 10B (1). Here, for convenience's sake, the width (height in FIG. 1B) of each flat plate portion 11, 12 is designated by S1, the width (height) including the upper and lower protrusions 11*b*, 12*b* is designated by S2, the protrusive height of each protrusion 11*b*, 12*b* is designated by S3 and the distance between the outer side surface of the protrusion 11*b* of the first flat plate portion 11 and the outer side surface of the protrusion 12*b* of the second flat plate portion 12 is designated by L1. These dimensions serve as references for determining the dimensions of the insulating housing 50.

On the other hand, the insulating housing 50 shown in FIGS. 2A to 2C has a rectangular cylindrical body 50A and a pair of end walls 55, 58. The rectangular cylindrical body 50A includes a pair of opposed parallel side walls 51, 52 and a pair of opposed parallel upper and lower walls 53, 54, which are made of a resin and formed integrally into a rectangular box shape. The pair of the end walls 55, 58 are configured to close openings of respective end portions of the rectangular cylindrical body 50A.

As shown in FIG. 2B, one end wall 55 of the pair of the end walls 55, 58 is provided as a fixed wall (hereinafter referred to as "fixed wall 55") which has a slit 56 located in a position closer to the side wall 52 and by which the opening of the one end portion of the rectangular cylindrical body 50A is fixedly closed. The first flat plate portion 11 of the fuse element 10B can be inserted through the slit 56.

In addition, the other end wall 58 of the pair of the end walls 55, 58 is provided as a lid (hereinafter referred to as "lid 58") by which the opening of the other end portion made open as a fuse element insertion port 57 of the rectangular cylindrical body 50A is closed from behind after the fuse element 10B is inserted. The other end wall 58 is integrally coupled to an edge portion of the one side wall 51 of the rectangular cylindrical body 50A so as to be rotatable around a hinge 60.

The lid 58 is provided with a rectangular notch 58*b* on an opposite side edge (side edge which makes contact with the side wall 52 when the lid 58 is closed) to the hinge 60. When the lid 58 is closed, a slit 59 through which the second flat plate portion 12 can be inserted is formed between the lid 58 and the side wall 52. Protrusions 58*a* for forming the notch 58*b* are left on an upper side and a lower side of the notch 58*b*.

The dimensional relation between the insulating housing 50 and the fuse element 10B will be described here. The height S4 of the slit 56 of the fixed wall 55 in the insulating housing 50 is set to be equal to or slightly larger than the height (width) S1 of the first flat plate portion 11 in the fuse element 10B. In addition, the width T3 of the slit 56 is set to be equal to or slightly larger than the thickness T2 of the first terminal portion 21 in the fuse element 10B.

In addition, the height S5 between inner surfaces of the upper wall 53 and the lower wall 54 in the insulating housing 50 is set to be equal to or slightly larger than the height (width) S2 including the protrusions 11*b*, 12*b* of each flat plate portion 11, 12 in the fuse element 10B. Moreover, the height S6 between an upper edge of the slit 56 of the fixed wall 55 and the inner surface of the upper wall 53 and the height S6 between a lower edge of the slit 56 of the fixed wall 55 and the inner surface of the lower wall 54 serve as engaging allowances for the protrusions 11*b* in the upper and lower edges of the first flat plate portion 11 in the fuse element 10B. Accordingly, the heights S6 are set in accordance with the protrusive heights S3 of the protrusions 11*b* in order to secure the necessary and sufficient engaging allowances.

In addition, the height S8 and the width T5 of the lid 58 in the insulating housing 50 are set at dimensions with which the lid 58 can be just fitted into the fuse element insertion port 57. The height S7 and the width T4 of the slit 59 (notch 58*b*) formed between the lid 58 and the side wall 52 when the lid 58 is closed are set at dimensions with which the second flat plate portion 12 in the fuse element 10B can be just inserted through the slit 59. That is, the height S7 of the slit 59 is set to be equal to or slightly larger than the height (width) S1 of the second flat plate portion 12. The width T4 of the slip 59 is set to be equal to or slightly larger than the thickness T1 of the second flat plate portion 12.

In addition, the height (height of the protrusion 58*a* on the upper side) S9 between an upper edge of the slit 59 and the inner surface of the upper wall 53 and the height (height of the protrusion 58*a* on the lower side) S9 between a lower edge of the slit 56 in the fixed wall 55 and the inner surface of the lower wall 54 serve as engaging allowances for the protrusions 12*b* in the upper and lower edges of the second flat plate portion 12 in the fuse element 10B. Accordingly, the heights S9 are set in accordance with the protrusive heights of the protrusions 12*b* in order to secure the necessary and sufficient engaging allowances.

In addition, the distance L2 between an inner surface of the fixed wall 55 and an inner surface of the lid 58 when the lid 58 is closed is set to be equal to or slightly larger than the distance L1 between the outer side surface of the protrusion 11*b* of the first flat plate portion 11 and the outer side surface of the protrusion 12*b* of the second flat plate portion 12.

In the case where the fuse element 10B shown in FIG. 1B is assembled in the insulating housing 50 configured thus, an end portion (outer edge portion 21*a* of the first terminal portion 21 whose thickness has become T2) of the first flat plate portion 11 in the fuse element 10B is set as a distal end side of an introduction direction and the fuse element 10B is inserted into the insulating housing 50 from the fuse element insertion port 57, as shown in FIGS. 3 to 6. The first terminal portion 21 on the outer edge side of the first flat plate portion 11 protrudes outward from the insulating housing 50 through the slit 56 of the fixed wall 55 while the protrusions 11*b* provided on the upper and lower edges of the first flat plate portion 11 abut against the inner surface of the fixed wall 55. In this manner, the inner edge 11*a*, 12*a* sides of the first and second flat plate portions 11, 12 and the fusible portion 13 in the fuse element 10B can be accommodated inside the insulating housing 50 while the fuse element 10B is positioned relative to the insulating housing 50.

Figure 7:
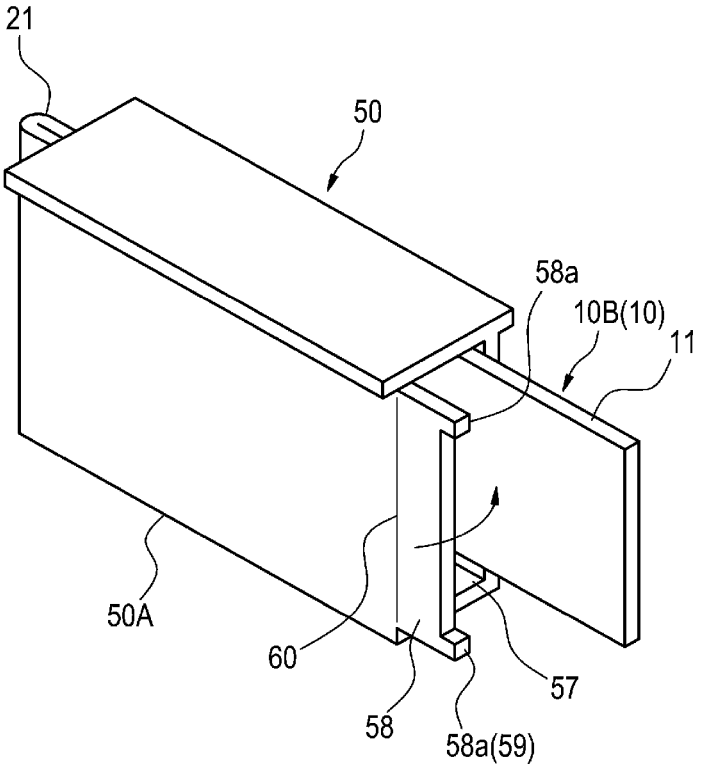
FIG. 7 is a perspective view illustrating the state of FIG. 5 and FIG. 6.

FIG. 7 shows a state in which the fuse element 10B has been inserted into the insulating housing 50. Since the lid 58 is rotated in this state, the fuse element insertion port 57 is closed such that the outer edge 12*c* side of the second flat plate portion 12 protrudes outward from the insulating housing 50 through the slit 59 of the lid 58, as shown in FIG. 8. When the lid 58 abuts against the protrusions 12*b* provided in the upper and lower edges of the second flat plate portion 12, the closed position of the lid 58 is positioned.

After the lid 58 is closed, the outer edge 12*c* side of the second flat plate portion 12 protruding outward from the insulating housing 50 is then folded back to the inner side to provide a double layer structure in the same manner as the first flat plate portion 11, so that this double layer portion is configured as a second terminal portion 22 having a thickness twice as large as the original thickness T1 of the flat plate portion 12. At this time, the lid 58 is locked by the second terminal portion 22 from the outside.

In this manner, the fuse 1 according to the embodiment shown in FIGS. 9 to 11 can be obtained. When the fuse 1 is mounted on counterpart terminals, the first terminal portion 21 and the second terminal portion 22 are inserted between a pair of holding arms 71*a*, 72*a* of the counterpart terminals 71, 72, as shown in FIG. 12. In this manner, the terminal portions 21, 22 are held and fixed by the pair of holding arms 71*a*, 72*a*.

According to the fuse 1 according to the embodiment, the thickness T2 of each of the terminal portions 21, 22 exposed outside the insulating housing 50 increases to be twice as large as the thickness of the raw material (flat metal plate) of the fuse element 10. Accordingly, it is possible to increase a thermal distribution region during electrical conduction and it is possible to suppress the temperature of the fuse element 10 from increasing. Accordingly, it is possible to solve the problem of the thermal effect on the insulating housing 50 or its periphery in the case where the fuse 1 is downsized.

In addition, when the terminal portions 21, 22 are held and fixed by the counterpart terminals 71, 72, the force with which the counterpart terminals 71, 72 hold and fix the fuse 1 can be enhanced because the thickness of each terminal portion 21, 22 has increased. Accordingly, it is possible to prevent the fuse 1 from being mounted unstably when the fuse 1 is downsized.

In addition, the fuse element 10 is positioned when the protrusions 11*b* and 12*b* formed in the fuse element 10 abut against the inner surfaces of the end walls 55, 58 of the insulating housing 50. Accordingly, it is possible to determine the positional relation between the insulating housing 50 and the fuse element 10 accurately and it is possible to make the quality of the fuse 1 stable.

The fuse element 10 is inserted from the fuse element insertion port 57 provided at one end of the insulating housing 50. After the fuse element 10 is inserted, the fuse element insertion port 57 is closed by the lid 58. In this state, the lid 58 is locked from the outside by the terminal portion 22 which is formed by folding the flat plate portion 12 of the fuse element 10. Accordingly, the lid 58 can be fixed so as not to be opened and the fuse having a robust structure can be assembled easily.

The present invention is not limited to the embodiment described above, and changes and modifications may be made therein as appropriate. Moreover, materials, shapes, dimensions, numbers, locations of the respective elements in the embodiment described above are not limited, and are optional in so far as the present invention can be achieved.

For example, in the aforementioned embodiment, the number of folded layers of each of the terminal portions 21, 22 is two. However, each terminal portion 21, 22 may be folded into three or more layers.

In addition, in the aforementioned embodiment, the timing when the outer edge 11*c* side of the first flat plate portion 11 is folded to form the first terminal portion 21 is set at a time instant before the fuse element 10B (10) is inserted into the insulating housing 50. However, the timing may be set at a time instant after the fuse element 10A (10) is inserted. That is, the fuse element 10A having the shape shown in FIG. 1A may be inserted into the insulating housing 50 and the outer edge 11*c* side of the first flat plate portion 11 protruding outward from the slit 56 of the fixed wall 55 may be folded to form the first terminal portion 21 after the fuse element 10A is inserted. In this case, the part which is inserted through the slit 56 of the fixed wall 55 is the outer edge 11*c* side of the first flat plate portion 11 which has not been folded into two layers yet. Accordingly, the width T3 of the slit 56 of the fixed wall 55 may be set as width (dimension equal to or slightly larger than T1) such that one first flat plate portion 11 which has not been folded can be inserted through the slit 56.

Here, the aforementioned characteristics of the embodiment of the fuse and the method for producing the fuse according to the invention will be summarized briefly in the following [1] to [3].

[1] A fuse (1) including:

a fuse element (10) having a pair of flat plate portions (11, 12) forming terminal portions at both ends of the fuse element and a fusible portion (13) provided between opposed inner edges (11*a*, 12*a*) of the pair of flat plate portions (11, 12), the flat plate portions (11, 12) being formed to have a uniform thickness; and an insulating housing (50) formed in a box shape and provided to cover the inner edge (11*a*, 12*a*) sides of the pair of flat plate portions (11, 12) and the fusible portion (13) in a state in which outer edge (11*c*, 12*c*) sides of the pair of flat plate portions (11, 12) are protruded outward from slits (56, 59) formed in opposed end walls (55, 58) of the insulating housing (50); wherein:

the pair of flat plate portions (11, 12) protruded outward from the slits (56, 59) in the end walls (55, 58) of the insulating housing (50) are folded into a plurality of layers to form the outer edge (11*c*, 12*c*) sides of the flat plates (11, 12) as terminal portions (21, 22) each having a greater thickness than each of the flat plate portions (11, 12); and the protrusions (11*b*, 12*b*) provided on side edges of portions of the pair of flat plate portions (11, 12) to be positioned inside the insulating housing (50) abut against inner surfaces of the end walls (55, 58) of the insulating housing (50).

[2] A fuse (1) according to [1] described above, wherein a fuse element insertion port (57) from which the fuse element (10) is inserted is provided at one end of the insulating housing (50); and one end wall (58) of the end walls (55, 58) is provided as a lid (58) that closes the fuse element insertion port (57) after inserting the fuse element (10), and in a state in which the fuse element insertion port (57) is closed after inserting the fuse element (10), the lid (58) is locked from the outside by the terminal portion (22) formed by folding the flat plate portion (12).

[3] A method for producing a fuse (1), the method including steps of:

preparing a fuse element (10) having a pair of first and second flat plate portions (11, 12) to form terminal portions at both ends of the fuse element and a fusible portion (13) provided between opposed inner edges (11*a*, 12*a*) of the first and second flat plate portions (11, 12), at least the flat plate portions (11, 12) being formed by punching a flat metal plate having a uniform thickness;

preparing an insulating housing (50) having a rectangular cylindrical body (50A) and a pair of end walls (55, 58) configured to close openings at end portions of the rectangular cylindrical body (50A), one of the pair of end walls being provided as a fixed wall (55) which has a slit (56) through which the first flat plate portion (11) is inserted and fixedly closing one of the openings at the end portions of the rectangular cylindrical body (50A), the other of the pair of end walls being rotatably connected to the rectangular cylindrical body (50A) via a hinge (60) and provided as a lid (58) that closes the other of the openings at the end portions of the rectangular cylindrical housing (50A) after inserting the fuse element, the other of the openings being opened as a fuse element insertion port (57), and the lid (58) having a slit (59) through which the second flat plate portion is inserted on a side edge opposite to the hinge;

inserting the first flat plate portion (11) of the fuse element (10) into the insulating housing (50) from the fuse element insertion port (57) such that an outer edge (11*c*) side of the first flat plate portion (11) protrudes outward from the insulating housing (50) through the slit (56) of the fixed wall (55) and such that a protrusion (11*b*) provided on a side edge of the first flat plate portion (11) abuts against an inner surface of the fixed wall (55) to position the fuse element (10) relative to the insulating housing (50), so that the inner edge (11*a*, 12*a*) sides of the first and second flat plate portions (11, 12) on the sides of and the fusible portion (13) of the fuse element (10) are accommodated inside the insulating housing (50);

rotating the lid (58) after the inserting step to close the fuse element insertion port (57) such that an outer edge side of the second flat plate portion (12) is protruded outward from the insulating housing (50) through the slit (59) of the lid (58) and such that the lid (58) abuts against protrusions (12*b*) provided on side edges of the second flat plate portion (12) to position the lid (58) at a closed position;

folding the second flat plate portion (12) protruded outward from the insulating housing (50) into a plurality of layers after the lid (58) has been closed, such that the outer edge (12*c*) side of the flat plate portion (12) is formed as a second terminal portion (22) having a greater thickness than the flat metal plate and such that the lid (58) is locked from the outside by the second terminal portion (22); and folding the first flat plate portion (11) into a plurality of layers after or before the fuse element (10) is inserted into the insulating housing (50), such that the outer edge (11*c*) side of the flat plate portion (11) is formed as a first terminal portion (21) having a greater thickness than the flat metal plate.

The present application is based on Japanese Patent Application No. 2013-021544 filed on Feb. 6, 2013, the content of which is incorporated herein by reference.

INDUSTRIAL APPLICABILITY

According to the fuse and the method for producing the fuse according to the invention, it is possible to solve the problem of the thermal effect on the insulating housing or its periphery when the fuse is downsized. In addition, it is possible to enhance the force with which the counterpart terminals hold and fix the fuse and it is possible to prevent the fuse from being mounted unstably when the fuse is downsized. In addition, it is possible to determine the positional relation between the insulating housing and the fuse element accurately and it is possible to make the quality of the fuse stable.

LIST OF REFERENCE SIGNS

1 fuse
10, 10A, 10B fuse element
11 first flat plate portion
11*a* inner edge
11*b* protrusion
11*c* outer edge
12 second flat plate portion
12*a* inner edge
12*b* protrusion
12*c* outer edge
13 fusible portion
21 first terminal portion
22 second terminal portion
50 insulating housing
50A rectangular cylindrical body
55 fixed wall (end wall)
56 slit
57 fuse element insertion port
58 lid (end wall)
59 slit
60 hinge

The invention claimed is:

1. A fuse comprising:

a fuse element having a pair of flat plate portions forming terminal portions at both ends of the fuse element and a fusible portion provided between opposed inner edges of the pair of flat plate portions, the flat plate portions being formed to have a uniform thickness; and an insulating housing formed in a box shape and provided to cover inner edge sides of the pair of flat plate portions and the fusible portion in a state in which outer edge sides of the pair of flat plate portions are protruded outward from slits formed at opposed end walls of the insulating housing, wherein the pair of flat plate portions protruded outward from the slits at the end walls of the insulating housing are folded into a plurality of layers to form the outer edge sides of the flat plates as the terminal portions each having a greater thickness than each of the flat plate portions, wherein protrusions provided on side edges of portions of the pair of flat plate portions placed inside the insulating housing abut against inner surfaces of the end walls of the insulating housing, and wherein the fuse element, including the pair of flat plate portions and the fusible portion, has a single-plate structure, wherein a fuse element insertion port from which the fuse element is inserted is provided at one end of the insulating housing, and wherein one of the end walls is provided as a lid that closes the fuse element insertion port after inserting the fuse element, and in a state in which the fuse element insertion port is closed after inserting the fuse element, the lid is locked from an outside by one of the terminal portions formed by folding the flat plate portions.

2. A method for producing a fuse, the method comprising steps of:

preparing a fuse element having a pair of first and second flat plate portions forming terminal portions at both ends of the fuse element and a fusible portion provided between opposed inner edges of the first and second flat plate portions, at least the flat plate portions being formed by punching a flat metal plate having a uniform thickness;

preparing an insulating housing having a rectangular cylindrical body and a pair of end walls that close openings at end portions of the rectangular cylindrical body, one of the pair of end walls being provided as a fixed wall having a slit through which the first flat plate portion is inserted and fixedly closing one of the openings at the end portions of the rectangular cylindrical body, the other of the pair of end walls being rotatably connected to the rectangular cylindrical body via a hinge and provided as a lid that closes the other of the openings at the end portions of the rectangular cylindrical body after inserting the fuse element, the other of the openings being opened as a fuse element insertion port, and the lid having a slit through which the second flat plate portion is inserted on a side edge opposite to the hinge;

inserting the first flat plate portion of the fuse element into the insulating housing from the fuse element insertion port such that an outer edge side of the first flat plate portion protrudes outward from the insulating housing through the slit of the fixed wall and such that a protrusion provided on a side edge of the first flat plate portion abuts against an inner surface of the fixed wall to position the fuse element relative to the insulating housing, so that inner edge sides of the first and second flat plate portions and the fusible portion of the fuse element are accommodated inside the insulating housing;

rotating the lid after the inserting step to close the fuse element insertion port such that an outer edge side of the second flat plate portion is protruded outward from the insulating housing through the slit of the lid and such that the lid abuts against a protrusion provided on a side edge of the second flat plate portion to position the lid at a closed position;

folding the second flat plate portion protruded outward from the insulating housing into a plurality of layers after the lid has been closed, such that the outer edge side of the second flat plate portion is formed as a second terminal portion having a greater thickness than the flat metal plate and such that the lid is locked from an outside by the second terminal portion; and folding the first flat plate portion into a plurality of layers after or before the fuse element is inserted into the insulating housing, such that the outer edge side of the flat plate portion is formed as a first terminal portion having a greater thickness than the flat metal plate.

3. The fuse according to claim 1, wherein the portions of the pair of flat plate portions on which the protrusions are provided are non-folded.

4. The fuse according to claim 1, wherein a respective outermost surface of each of the folded pair of flat plate portions remains co-planar with a surface of the fusible portion.

5. A fuse comprising:

a fuse element having a pair of flat plate portions forming terminal portions at both ends of the fuse element and a fusible portion provided between opposed inner edges of the pair of flat plate portions, the flat plate portions being formed to have a uniform thickness; and an insulating housing formed in a box shape and provided to cover inner edge sides of the pair of flat plate portions and the fusible portion in a state in which outer edge sides of the pair of flat plate portions are protruded outward from slits formed at opposed end walls of the insulating housing, wherein the pair of flat plate portions protruded outward from the slits at the end walls of the insulating housing are folded into a plurality of layers to form the outer edge sides of the flat plates as the terminal portions each having a greater thickness than each of the flat plate portions, wherein protrusions provided on side edges of portions of the pair of flat plate portions placed inside the insulating housing abut against inner surfaces of the end walls of the insulating housing, wherein a fuse element insertion port from which the fuse element is inserted is provided at one end of the insulating housing, and wherein one of the end walls is provided as a lid that closes the fuse element insertion port after inserting the fuse element, and in a state in which the fuse element insertion port is closed after inserting the fuse element, the lid is locked from an outside by one of the terminal portions formed by folding the flat plate portions.

* * * * *